US009192969B2

(12) United States Patent
Saint

(10) Patent No.: US 9,192,969 B2
(45) Date of Patent: Nov. 24, 2015

(54) CLEANING DEVICE FOR SPRAY GUN

(75) Inventor: Patrick Saint, Chartres (FR)

(73) Assignee: FILLON TECHNOLOGIES, Faverolles (FR)

( * ) Notice: Subject to any disclaimer, the term of this patent is extended or adjusted under 35 U.S.C. 154(b) by 1097 days.

(21) Appl. No.: 13/259,251

(22) PCT Filed: Mar. 31, 2010

(86) PCT No.: PCT/FR2010/050603

§ 371 (c)(1), (2), (4) Date: Sep. 23, 2011

(87) PCT Pub. No.: WO2010/116070

PCT Pub. Date: Oct. 14, 2010

(65) Prior Publication Data

US 2012/0042912 A1 Feb. 23, 2012

(30) Foreign Application Priority Data

Apr. 8, 2009 (FR) ..... 09 01734
Apr. 8, 2009 (FR) ..... 09 01735

(51) Int. Cl.

| | |
|---|---|
| ***B05B 15/02*** | (2006.01) |
| ***B08B 9/032*** | (2006.01) |
| ***B08B 3/00*** | (2006.01) |
| ***B44D 3/00*** | (2006.01) |
| *B65D 83/14* | (2006.01) |

(52) U.S. Cl.

CPC ..... *B08B 9/032* (2013.01); *B05B 15/025* (2013.01); *B08B 3/006* (2013.01); *B44D 3/006* (2013.01); *B65D 83/14* (2013.01)

(58) Field of Classification Search

CPC ..... B05B 15/025

See application file for complete search history.

(56) References Cited

U.S. PATENT DOCUMENTS

| | | | | |
|---|---|---|---|---|
| 2,745,418 | A | 5/1956 | Balcom et al. | |
| 3,771,539 | A * | 11/1973 | De Santis | 134/111 |
| 7,785,420 | B2 | 8/2010 | Beijbom et al. | |

FOREIGN PATENT DOCUMENTS

| | | |
|---|---|---|
| FR | 2 903 332 | 1/2008 |
| GB | 2 182 266 | 5/1987 |
| WO | 2008/084327 | 7/2008 |

OTHER PUBLICATIONS

International Search Report dated Nov. 23, 2010, corresponding to PCT/FR2010/050603.

* cited by examiner

*Primary Examiner* — Jason Ko
(74) *Attorney, Agent, or Firm* — Young & Thompson

(57) ABSTRACT

A cleaning apparatus for cleaning a spray gun of the type having at least one paint inlet, and a fluid outlet, the cleaning apparatus has at least one support structure, a fluid feed head (3) carried by the structure (2), and removal elements for removing at least a fraction of the fluid coming from the fluid feed head (3), the fluid feed head having at least one feed nozzle (5) defining a duct serving to be connected to the paint inlet of the spray gun. The cleaning apparatus (1) has at least two independent fluid inlets (6, 7) for feeding fluid to the feed nozzle (5), each of the inlets having a distinct discharge (6A, 7A) into the duct of the feed nozzle, one of the inlets (6) being connectable to a cleaning fluid source, and the other (7) of the inlets being connectable to a compressed air source.

16 Claims, 7 Drawing Sheets

CLEANING DEVICE FOR SPRAY GUN

The present invention relates to apparatus for cleaning a spray gun.

Such cleaning machines are known as illustrated by Patent FR-2 903 332. Such machines are now tending to be designed with the objectives of reducing the number of handling operations to be performed by the operator, of procuring fast cleaning, and of simplifying the architecture of the machine. The aim is to enable an operator to clean and then to dry the gun without disconnecting the gun from the cleaning apparatus, while also simplifying the architecture of the apparatus, in particular by limiting the lengths of the ducts, and by preventing fluids of different types from passing through the same duct with a view to facilitating subsequent cleaning of the apparatus.

An object of the present invention is thus to propose improved cleaning apparatus, the design of which, with ducts that are shorter in length and that are each dedicated to a single type of fluid, enables an operator to clean and then to dry a gun without disconnecting the gun from the apparatus.

Another object of the present invention is to propose cleaning apparatus of the above-mentioned type, the design of which makes it possible to minimize stagnation of liquid fluid in the ducts of the cleaning apparatus.

To these ends, the invention provides cleaning apparatus for cleaning a spray gun of the type having at least one fluid inlet for the fluid to be sprayed or "paint inlet", and a fluid outlet, said cleaning apparatus having at least one support structure, a fluid feed head carried by said structure, and removal means for removing at least a fraction of the fluid coming from said fluid feed head, said fluid feed head having at least one feed nozzle defining a duct serving to be connected to the paint inlet of the spray gun, said cleaning apparatus being characterized in that the cleaning apparatus has at least two independent fluid inlets for feeding fluid to the feed nozzle, each of said inlets having a distinct discharge into the duct of said feed nozzle, one of said inlets being connectable to a cleaning fluid source, and the other of said inlets being connectable to a compressed air source.

By means of the facts that the fluid feed inlets are disposed in the immediate vicinity of the feed nozzle and that they are distinct, one serving to feed cleaning fluid to the nozzle for the purpose of cleaning the gun, and the other serving to feed compressed air to the nozzle for the purpose of drying said gun, cleaning the inlets and cleaning the cleaning and drying ducts connectable to said inlets is made easier and the lengths of said ducts are reduced.

In a preferred embodiment of the invention, the feed nozzle is coupled to the structure of the apparatus via at least one nozzle holder that, in co-operation with the nozzle, forms the feed head of the cleaning apparatus, said nozzle holder being in the shape of a tubular body that is of vertical axis, that is equipped, at its bottom end, with the feed nozzle and with fluid feed inlets for feeding fluid to said nozzle, and that is open at its top end to form an opening through which there can be inserted a cleaning fluid source, such as an aerosol receptacle, into said nozzle holder, said aerosol receptacle being suitable for being inserted via its diffuser, i.e. upside down, into the nozzle holder until the diffuser comes to be inserted at least partially into the cleaning fluid feed inlet of the feed nozzle that discharges into the duct of said feed nozzle.

This provision makes it possible to omit a pump from the cleaning apparatus and to adapt the characteristics of the cleaning fluid easily as a function of the type of fluid to be sprayed.

Preferably, the feed nozzle is mounted to move relative to the support structure towards or away from the removal means of the apparatus.

Such apparatus can thus be adapted to guns of various characteristics.

Preferably, the discharge of each fluid feed inlet of the feed nozzle is an axial discharge of axis parallel to the longitudinal axis of the duct of the feed nozzle.

This provision makes it possible to facilitate the flow of fluid in the nozzle, and makes it possible to form an axial fluid feed inlet in which the risks of liquid stagnating are reduced or are indeed zero.

Also preferably, the removal means of the cleaning apparatus comprise at least one fluid-receiving member designed to have its inlet connected to the fluid outlet of the gun. The feed nozzle and said fluid-receiving member are positioned relative to each other in a manner such as to be suitable for being connected at the same time respectively to said paint inlet of the spray gun and to the outlet of the spray gun.

By means of this provision, the operator can, without disconnecting the gun from the cleaning apparatus, feed cleaning fluid to the gun, and empty and dry it.

In a preferred embodiment of the invention, in which the outlet of the spray gun to be cleaned has at least one axial outlet for the fluid to be sprayed, and at least one and preferably a plurality of preferably radial outlet(s) or "pressurized gas outlet(s)" serving, for example, to adjust the shape of the fluid flow coming from the axial outlet, said cleaning apparatus is characterized in that said fluid-receiving member has firstly at least one fluid-receiving nozzle that is preferably cylindroconical in shape and that is connectable, at its outlet, to means for collecting the sprayed fluid flow, and being connectable, at its inlet, to the gun's axial outlet for the flow of fluid to be sprayed, and secondly at least one gas removal duct connectable at its inlet to the at least one gas outlet of said gun and discharging, at its outlet, into a "gas removal zone" that is distinct from the means for collecting the flow of sprayed fluid.

Preferably, in addition to the fluid-receiving nozzle that is designed to co-operate with the axial outlet of the spray gun, said fluid-receiving member has a ring surrounding said nozzle, the inlet of the at least one removal duct being provided between the ring and the fluid-receiving nozzle.

In addition, generally, an annular sealing gasket having a convex outside peripheral surface is received inside said ring.

Preferably, the gasket, received inside the ring is loaded by a spring and is urged back into a position in which it bears against an inside peripheral circumferential shoulder of the ring. The gas removal zone is formed by the ambient air surrounding said cleaning apparatus so that the end of the removal duct that is distinct from the means for collecting the flow of fluid discharges into the surrounding air. With the gas removal zone being formed by the ambient air surrounding the cleaning apparatus, the support structure, in its "back" zone, opposite from its front opening, has at least one opening and preferably a plurality of openings corresponding to the gas removal duct(s) discharging into the surrounding air.

In this embodiment, the user is not indisposed by the cleaning vapors, and the volume of cleaning fluid to be treated is reduced.

The invention can be well understood on reading the following description of embodiments, with reference to the accompanying drawings, in which.

Figure 1:
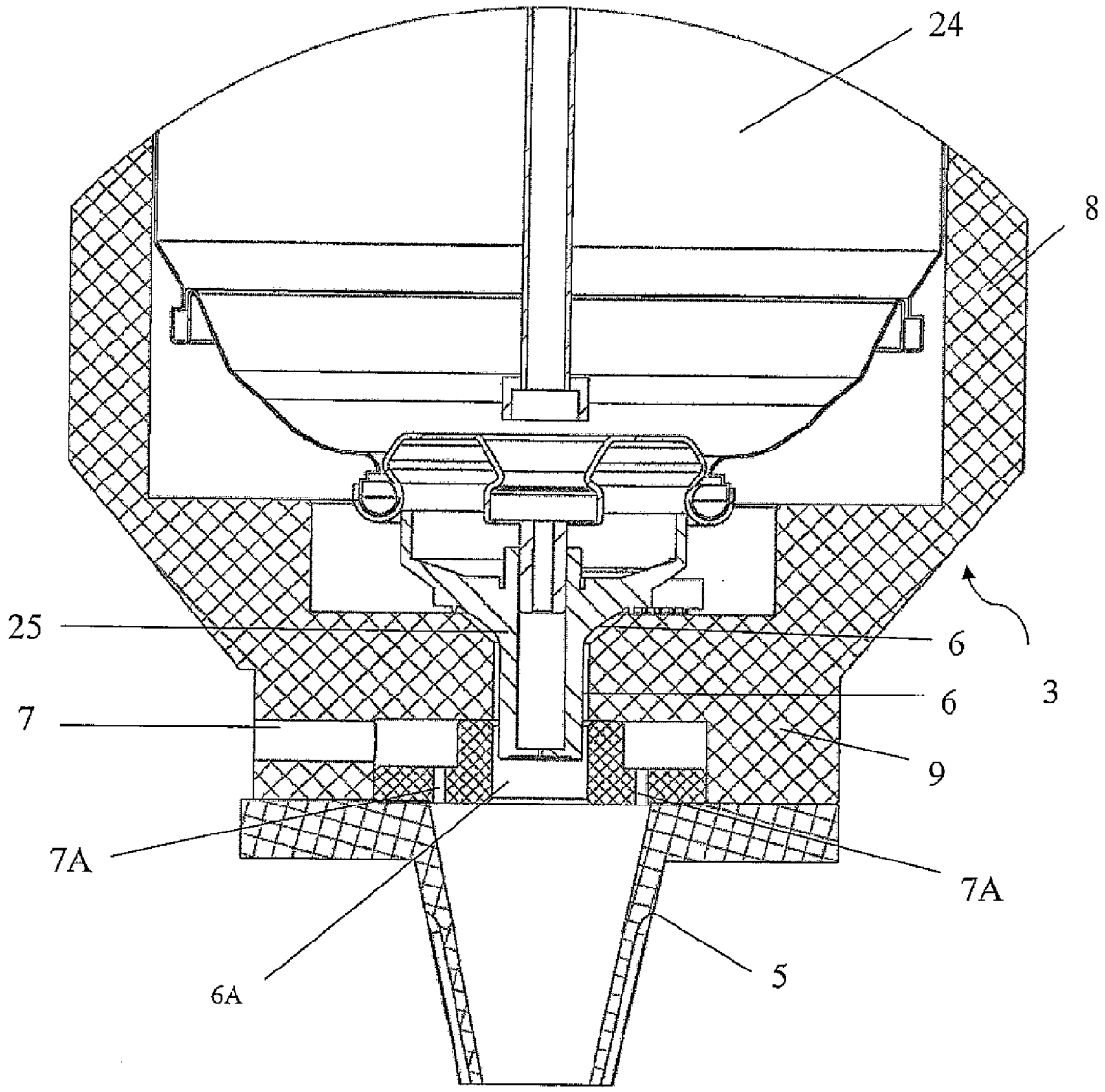
FIG. 1 is a fragmentary section view of the fluid feed head at the feed nozzle, the cleaning source being formed by an aerosol receptacle.

As mentioned above, the cleaning apparatus of the invention has a support structure 2 defining a cleaning volume 22, such as an enclosure, suitable for at least partially receiving a spray gun to be cleaned. Said support structure 2 carries a fluid feed head 3 having at least one feed nozzle 5 designed to be connected to the paint inlet 27 of the spray gun to be cleaned. Said cleaning apparatus also has removal means 4 for removing at least a fraction of the fluid coming from the fluid feed head 3.

Figure 5:
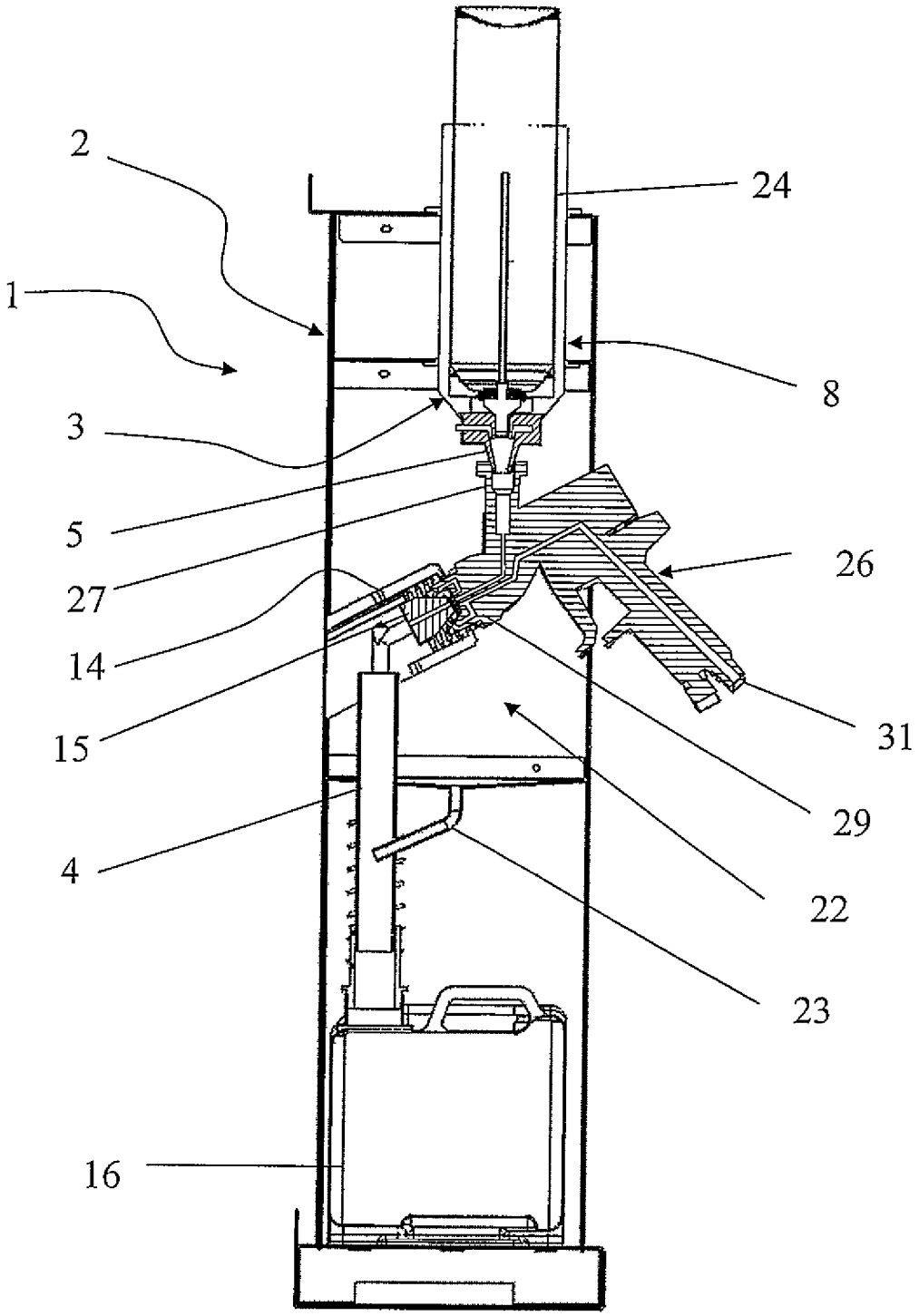
FIG. 5 is a fragmentary diagrammatic section view of the cleaning apparatus in the state in which the nozzles of the apparatus are connected to the inlet and to the outlet of a spray gun.

The cleaning apparatus is designed to clean spray guns. As shown in FIG. 5, a spray gun 26 can be placed partially inside the volume 22. In particular, the spray gun 26 has a fluid inlet 27 for the fluid to be sprayed or "paint inlet" 27, an internal duct, and a fluid outlet 28, the internal duct extending between the fluid inlet 27 and the fluid outlet 28. Such a gun also has an air inlet 31 that is connectable to a compressed air feed source. Said air inlet 31 makes it possible, in particular, to help the fluid to flow from the paint inlet 27 to the fluid outlet 28 and to be ejected from the gun when the trigger of the gun is actuated. Said air inlet 31 also makes it possible to feed a gas outlet 30 of the gun serving to adjust the shape of the fluid flow. Generally, the outlet 28 of the spray gun to be cleaned has at least one axial outlet 29 for the fluid to be sprayed that is formed of a gas-and-liquid mixture, and at least one and preferably a plurality of preferably radial outlet(s) 30 or "pressurized gas outlet(s)" serving to adjust the shape of the fluid flow coming from the axial outlet.

The gas outlets 30 are disposed around the axial outlet 29. When the spray gun 26 is used for painting, a paint cup (not shown) is connected to the paint inlet 27. The paint passes into the internal duct and exits via the outlet 28, in particular via the axial outlet 29 for the fluid to be sprayed of the outlet 28. When the spray gun 26 is to be cleaned, it is connected to the cleaning apparatus 1, as shown in FIG. 5. More precisely, the paint cup is removed and the paint inlet 27 is connected to the feed nozzle 5 of the feed head 3.

Then, the feed head 3 can be caused to make the cleaning fluid flow.

In a manner characteristic of the invention, the cleaning apparatus 1 has at least two independent inlets 6, 7, for feeding fluid to the feed nozzle 5. Each of said inlets 6, 7 has a distinct discharge 6A, 7A into the duct of said feed nozzle 5, one (6) of said inlets 6, 7 being connectable to a cleaning fluid source, and the other (7) being connectable to a compressed air source.

Thus, in the state in which the inlets 6, 7 are connected to their respective fluid sources, during the cleaning stage, the cleaning fluid feeds the feed nozzle 5 via the inlet 6 and goes successively via the paint inlet 27, via the internal duct, and via the outlet 28 of the gun, in particular via the axial outlet 29 of the outlet 28. During the drying stage, compressed air feeds the feed nozzle 5 via the inlet 7, and goes successively via the paint inlet 27, via the internal duct, and via the outlet 28 of the gun, in particular via the axial outlet 29 of the outlet 28 of the gun. This drying makes it possible to remove the cleaning fluid remaining in the internal duct of the gun between the inlet 27 and the outlet 28 of said gun.

In the example shown, the structure 2 is in the shape of a column provided with a front opening through which the gun is inserted into the column and into the cleaning volume 22. Said cleaning volume 22 is defined at least by the peripheral wall of the structure. The feed head 3 is disposed at or in the vicinity of the top of the structure and thus extends essentially above the gun in the state in which the gun is inserted into the cleaning volume 22.

The cleaning apparatus further includes removal means 4 for removing at least a fraction of the fluid coming from the cleaning fluid feed head 3. In the examples shown, the removal means 4 of the cleaning apparatus comprise at least one fluid-receiving means 14 designed to be connected at its inlet to the fluid outlet 28 of the gun 26. To this end, on its face facing towards the inside of the structure, the peripheral wall of the structure carries the fluid-receiving means 14, which are thus received inside the cleaning volume 22. This fluid-receiving member 14 extends substantially facing the front opening of the structure.

Preferably, the feed nozzle 5 and said fluid-receiving member 14 are positioned relative to each other in such a manner as to be suitable for being connected at the same time respectively to said paint inlet 27 of the spray gun 26 and to the outlet 28 of the spray gun.

Also preferably, said fluid-receiving member 14 has at least one fluid-receiving nozzle 15 that is preferably cylindroconical in shape, said fluid-receiving nozzle 15 being connected at its outlet to means 16 for collecting the sprayed fluid flow, and being connectable at its inlet to the gun's axial outlet 29 for the fluid to be sprayed. This inlet connection makes it possible to direct the fluid flow towards said collection means 16. When it is in the state in which it is connected to said axial outlet 29, said fluid-receiving nozzle 15 is suitable for preventing any action from the gas coming from the gas outlets 30 on the fluid flow coming from the axial outlet.

In addition to the at least one fluid-receiving nozzle 15 connected, at its outlet, to means 16 for collecting the sprayed fluid flow, and connectable, at its inlet, to the gun's axial outlet 29 for the flow of fluid to be sprayed, the fluid-receiving member 14 has at least one gas removal duct 17 connectable, at its inlet, to the at least one gas outlet 30 of said gun and discharging, at its outlet, into a "gas removal zone" that is distinct from the means 16 for collecting the sprayed fluid flow so as to remove the gases from the gun into a removal zone.

In addition to the fluid-receiving nozzle 15 that is designed to co-operate with the axial outlet 29 of the spray gun and to the removal duct 17, the fluid-receiving member 14 has a ring 18 surrounding said nozzle 15, in particular the frustoconical portion of said nozzle 15, the inlet of the at least one removal duct 17 being provided between the ring 18 and the fluid-receiving nozzle 15. An annular sealing gasket 19 having a convex outside peripheral surface is received inside said ring 18.

Said at least one gas removal duct 17 has an inlet provided in the volume formed by the space left empty between the ring 18 and the fluid-receiving nozzle 15, in particular the frustoconical portion of said nozzle 15, and an opposite end or "outlet" that discharges into the gas removal zone. In the examples shown, the gas removal zone is formed by the ambient air surrounding the cleaning apparatus so that said at least one gas removal duct discharges into the surrounding air. To this end, in its "back" zone, opposite from its front opening, the support structure 2 has at least one opening and preferably a plurality of openings corresponding to the gas removal duct(s) discharging into the surrounding air. The gasket 19 received inside the ring 18, is loaded by a spring 20 and is urged back into a position in which it bears against a peripheral circumferential shoulder 21 inside the ring 18. In the state in which the outlet 28 of the gun is connected to the fluid-receiving member 14, said gasket 19 surrounds the barrel of the gun with leaktight bearing contact and prevents any air that exits from the end of the barrel of the gun via the gas outlets 30 from escaping from the volume defined by the ring 18, by the nozzle 15 and by said gasket 19 and forming the inlet of the at least one removal duct 17. The convex outside peripheral surface of the gasket 19 enables said gasket to swivel inside the recess formed by the ring when the barrel of the gun is inserted into the gasket until the end of the barrel of the gun comes into bearing contact with the conical end of the fluid-receiving nozzle 15 and comes to cap the end of said nozzle. It should be noted that said nozzle end is preferably made of an elastically deformable material. In this position in which the fluid axial outlet 29 of the gun is in bearing contact with the conical end of the fluid-receiving nozzle 15, the gas radial outlet 30 for the gases from the barrel of the gun discharges into the volume extending between the ring 18, the gasket 19, and the fluid-receiving nozzle 15, in which volume the inlet of the gas removal duct 17 is provided. Since the gasket 19 provides sealing with the barrel of the gun, the clean air is forced to be removed via the gas removal duct 17 and is brought into the atmosphere so that the volume of fluid to be treated that is collected in the collection means is smaller than in the state of the art. In the examples shown, said fluid-receiving member 14 has a plurality of gas removal ducts 17, said ducts being disposed equidistant from the axis of the fluid-receiving nozzle 15. Thus, the inlets of the ducts 17 for removing the gases from the space formed between the ring 18 and the fluid-receiving nozzle 15 are disposed on a circle of center situated on the central axis of the fluid-receiving nozzle. The possibilities of removing gas to the atmosphere are thus increased.

It can be seen that the fluid-receiving nozzle 15 is cylindroconical in shape. This enables the fluid-receiving nozzle 15 to be connected to guns having paint outlets of different diameters.

Thus, during a cleaning stage, the cleaning fluid leaves the cleaning head 3 and goes successively via the feed nozzle 5, via the paint outlet 27, via the internal duct, via the outlet 28 of the gun, and via the fluid-receiving member 14, and then arrives in the collection means 16. As can be observed, the cleaning fluid thus flows around a closed circuit from the feed head 3 to the collection means 16. Thus, it is possible to prevent the cleaning fluid from evaporating into the environment of the cleaning apparatus 1. User indisposition is thus avoided. After the cleaning fluid has been caused to flow, the feed head 3 can be controlled so that compressed air is caused to flow around the above-mentioned closed circuit in order to dry the spray gun, and more precisely in order to remove any cleaning fluid remaining in the internal circuit. In this example, the means 16 for collecting the cleaning fluid to be treated are formed of a duct connected to the outlet of the fluid-receiving nozzle 15, and of a reservoir fed with cleaning fluid to be treated by said duct. This reservoir is a reservoir received in the base of the support structure, generally in removable manner so that it can be emptied.

The apparatus also has fluid removal means 4 disposed in the bottom portion of the cleaning volume 22 of the support structure. This cleaning volume 22 is defined at least by the peripheral wall of the structure and by an inclined bottom wall defining a dish inside the structure in order to guide a flow towards a drain duct 23 that discharges into the feed duct of the reservoir of the collection means. Thus, if, while the spray gun 26 is being put into place or is being removed, paint or cleaning fluid flows into the volume 22, the bottom wall and the drain duct enables it to be collected towards the reservoir of cleaning fluid to be treated.

Figure 6:
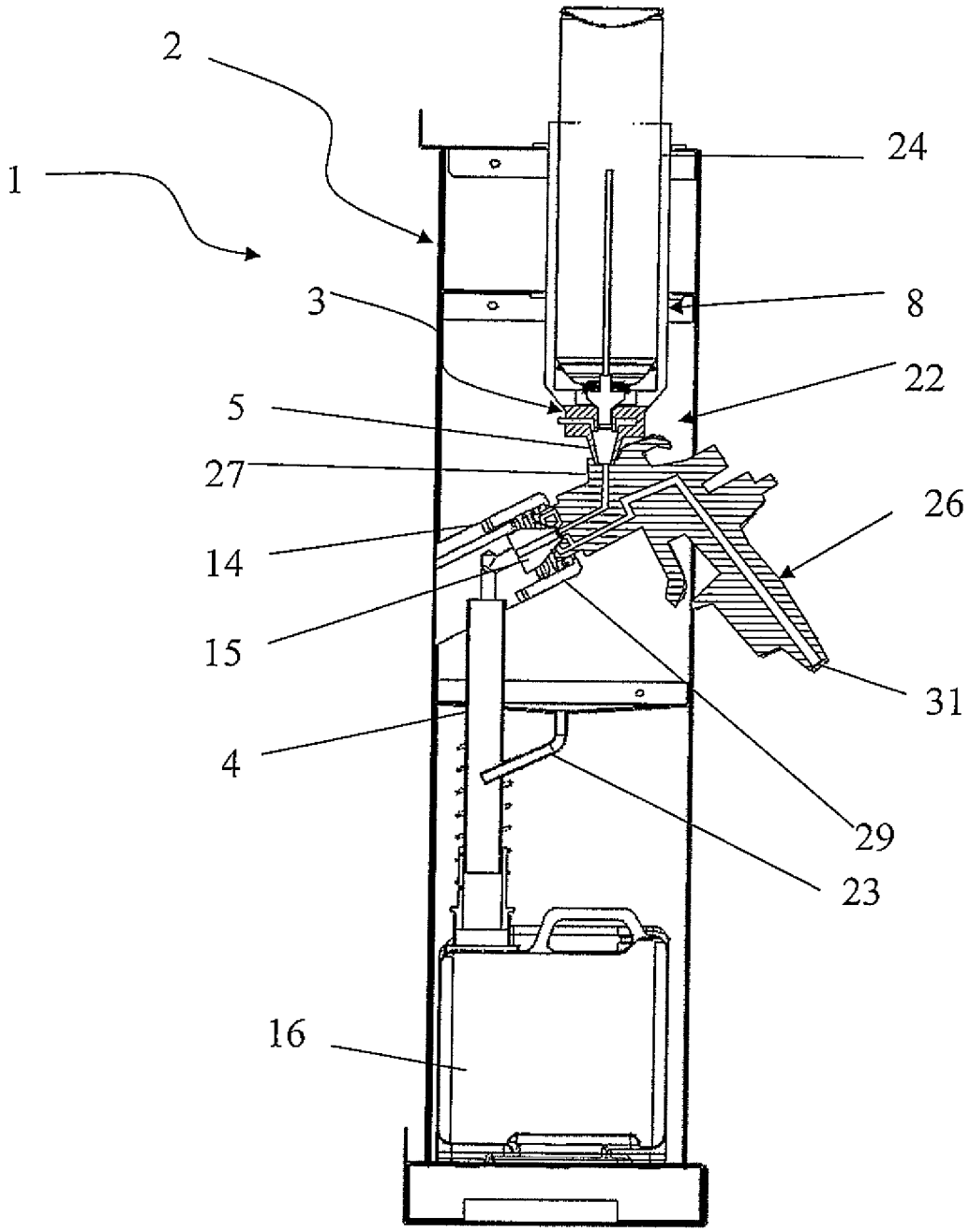
FIG. 6 shows a view similar to FIG. 5 for a gun having different dimensional characteristics.
Figure 7:
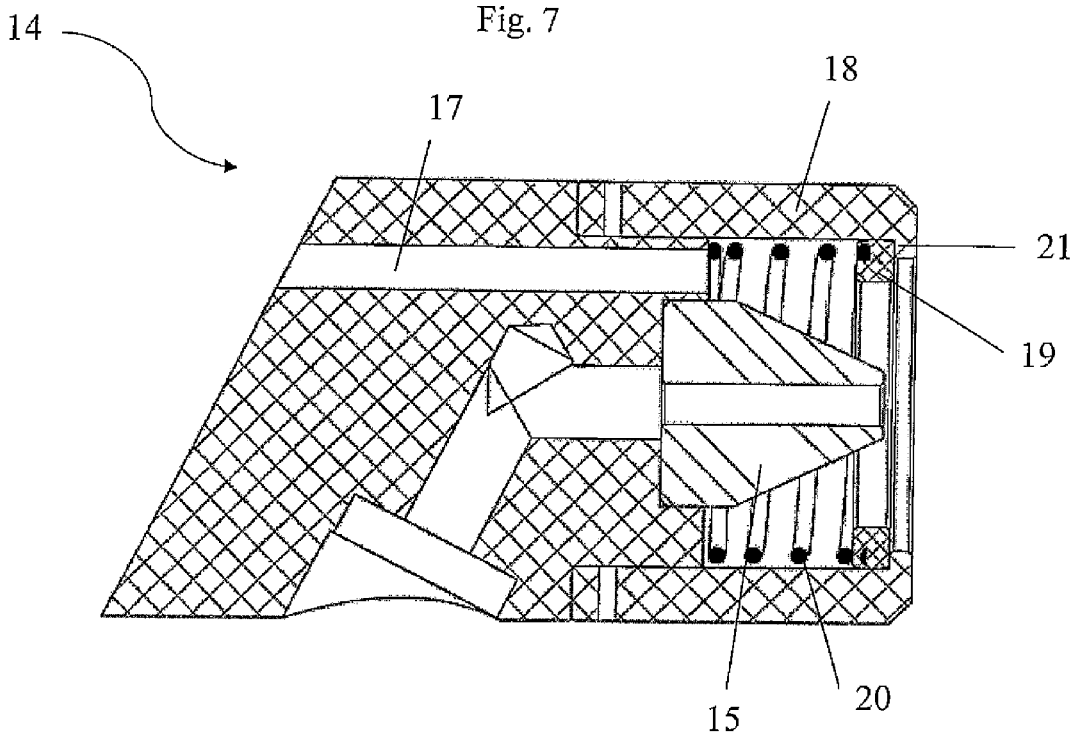
FIG. 7 is a detail section view of the fluid-receiving member.
Figure 8:
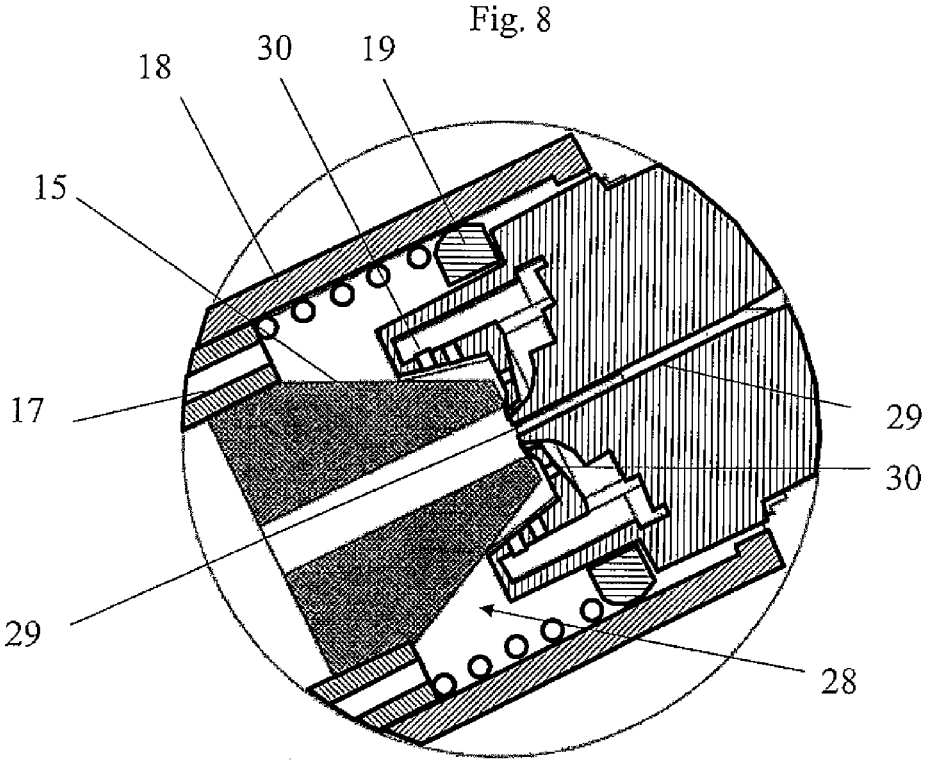
FIG. 8 is a fragmentary detail section view of the fluid-receiving member in the state in which it is connected to the outlet of a gun.

As shown in FIGS. 5 and 6, the feed nozzle 5 is mounted to move relative to the support structure 2 towards or away from the removal means 4 of the apparatus.

In particular, the feed nozzle 5 is mounted to move upwards and downwards between a high position remote from the removal means 4 and a low position close to said removal means 4, said low position being a position that is adjustable as a function of at least the dimensional characteristics of the spray gun to be cleaned.

Thus, when the feed nozzle 5 and the fluid-receiving member 14 are positioned relative to each other in such a manner as to be connected at the same time respectively to said paint inlet 27 of the spray gun 26 and to the outlet 28 of the spray gun, adjusting the level of the feed nozzle 5 makes it possible to vary its position relative to the fluid-receiving member 14, and thus to accommodate guns of different characteristics as shown in FIGS. 5 and 6, it being possible for said guns to have different paint inlet dimensions, different outlet dimensions, and different distances and relative angular positioning between the paint inlet and the outlet of the gun. The feed head 3 is shown in detail in FIGS. 1 and 2.

In the examples shown, the feed nozzle 5 is coupled to the structure 2 of the cleaning apparatus 1 at least via a nozzle holder 8 co-operating with the nozzle 5 to form the feed head 3 of the cleaning apparatus. The nozzle holder 8 is in the shape of a tubular body of vertical axis that, at its bottom end, is equipped with the feed nozzle 5, and that is open at its top end so as to form an opening through which to insert a cleaning fluid source such as an aerosol receptacle 24 into said nozzle holder 8. The aerosol receptacle 24 is suitable for being inserted via its diffuser 25, i.e. upside-down into the nozzle holder 8 until the diffuser 25 comes to be inserted at least partially into the cleaning fluid feed inlet 6 of the feed nozzle 5 discharging into the duct of the feed nozzle 5. This inlet 6 is formed by a through duct having a shoulder and provided through the bottom 9 of the body constituting the nozzle holder. Thus, generally manual pressure applied against the bottom of the aerosol receptacle 24 makes it possible, via the aerosol receptacle diffuser 25, to feed cleaning fluid to said nozzle. In addition to this through duct receiving the aerosol receptacle diffuser 25 and communicating with the feed nozzle 5, said nozzle holder 8 has an air inlet circuit portion that is connectable at one end to a compressed air feed source, and that discharges at its opposite end into said feed nozzle 5, while forming an air inlet 7 in said nozzle that is distinct from the cleaning fluid feed inlet 6. The discharge 6A, 7A of each fluid feed inlet 6, 7 of the feed nozzle 5 is an axial discharge of axis parallel to the longitudinal axis of the duct of the feed nozzle 5. The air inlet 7 and the cleaning fluid inlet 6 of the feed nozzle 5 are thus axial inlets disposed at the large-base end of the cone of the frustoconical feed nozzle 5 in such a manner as to facilitate the flow of the fluids inside the nozzle. The two distinct inlets make it possible, without disconnecting the gun and with simple mounting, firstly to clean the gun and then secondly to dry the gun. The nozzle holder 8 is mounted on said structure to be movable slidably in a direction parallel to the longitudinal axis of the tubular body constituting the nozzle holder. For this purpose, the nozzle holder 8 and the structure 2 are equipped with means such as rails, runners, rolling members, shoes or the like for slidably mounting the nozzle holder on said structure. In detail, the nozzle holder has a cylindrical wall that defines a recess that is upwardly open for the purpose of inserting the aerosol receptacle into said recess. The bottom of the recess is closed by a bottom wall 9 that has a preferably central through duct provided with a shoulder. This duct discharges into the channel of the feed nozzle 5 and is substantially in alignment with said channel. This duct forms the cleaning fluid feed inlet 6 of the nozzle 5.

The air inlet 7 is also provided in the bottom wall of the nozzle holder 8 and discharges into the feed nozzle via axial passages. This air inlet is formed by an air inlet duct that is radial to the nozzle holder and that is connected to a compressed air source 33. This duct discharges into the annular volume disposed around the cleaning fluid feed inlet 6 of the nozzle. This annular volume is provided with axial passages aligned with the duct of the feed nozzle 5. These axial passages form the discharge 7A of the air inlet 7 into the nozzle 5. The feed head 3 also has radial handles 13, one of which is shown, that are fastened to the cylindrical wall of the nozzle holder 8, and that enable the feed head 3 to be moved. It can be seen that the feed nozzle 5 is frustoconical in shape. This makes it possible to connect the feed nozzle 5 to guns having paint inlets of different diameters.

Figure 2:
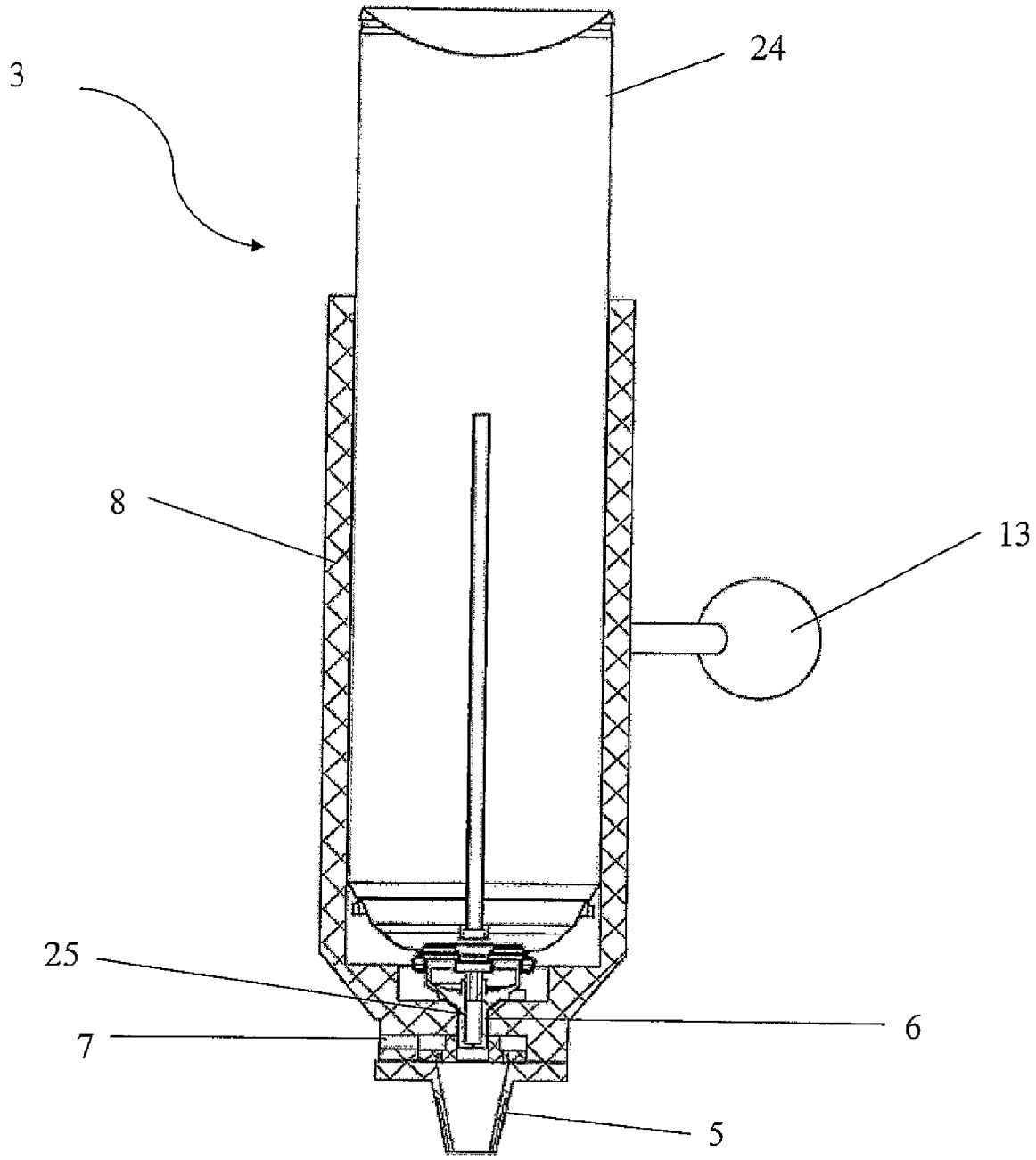
FIG. 2 is a section view of the feed head, the cleaning source being formed by an aerosol receptacle.
Figure 3:
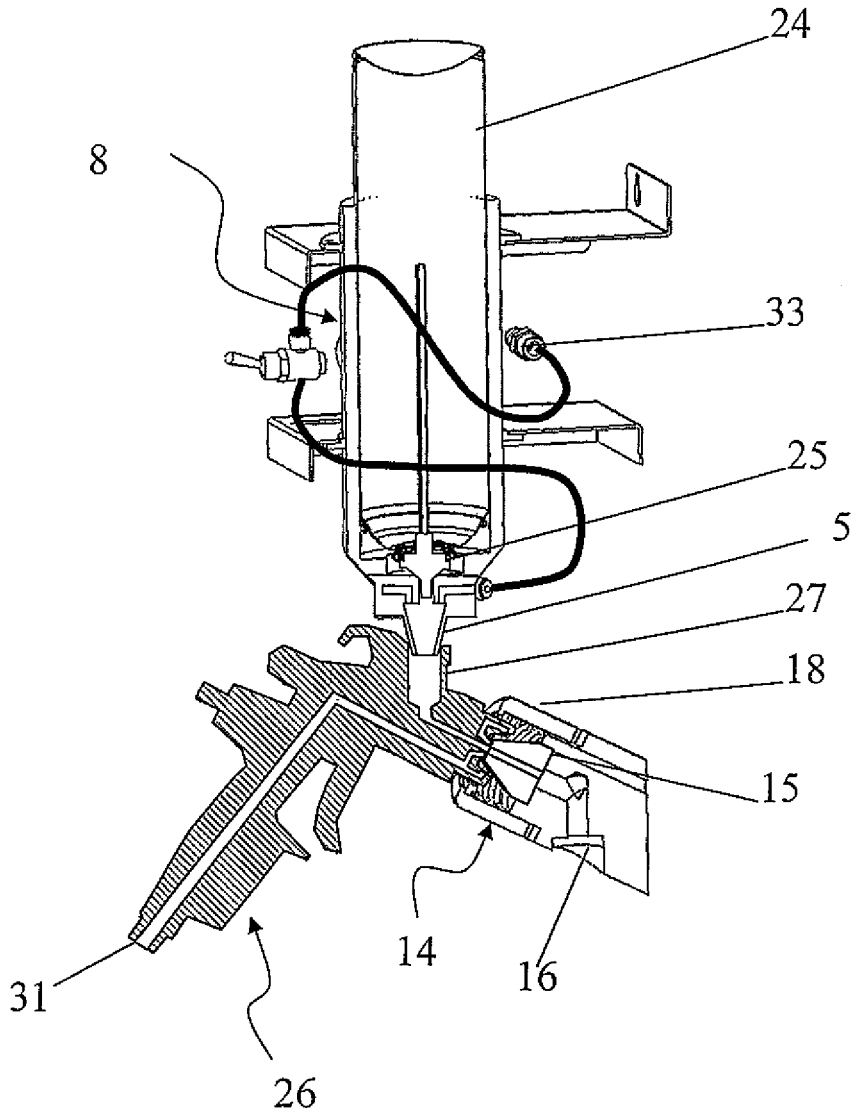
FIG. 3 is a diagrammatic section view of the feed head and a fragmentary view of the structure in the state in which the feed nozzle of the head is connected to the paint inlet of the spray gun.
Figure 4:
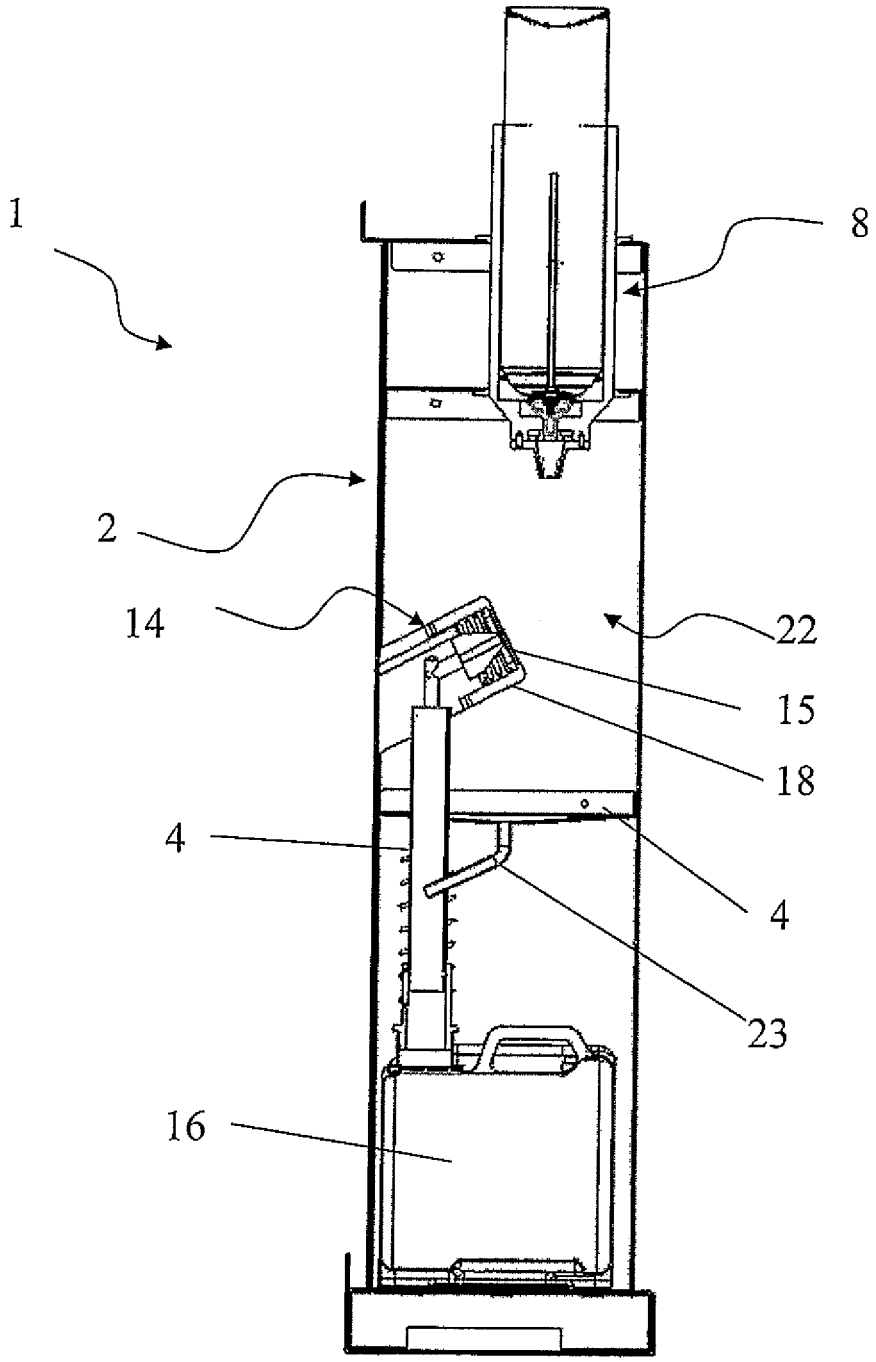
FIG. 4 is a fragmentary diagrammatic section view of the cleaning apparatus.

An aerosol receptacle 24 is arranged in the recess provided in the nozzle holder 8, upside-down. The aerosol receptacle 24 has a bottom, optionally has a dip tube, and has a diffuser 25. Cleaning fluid and pressurized propellant gas are contained in the receptacle 24. As shown in FIG. 2, the diffuser 25 is arranged in abutment in the through duct in the bottom wall of the nozzle holder. The aerosol receptacle 24 is mounted to be slidable in the recess. Thus, if a user presses on the bottom of the receptacle 24, the receptacle 24 moves closer to the diffuser 25, thereby causing a valve (not shown) of the aerosol receptacle 24 to open. The cleaning fluid contained in the receptacle 25 is then expelled and passes into the diffuser 25, into the inlet 6, and into the feed nozzle 5.

The aerosol receptacle 24 is easy to put in place in the recess, and easy to replace when empty. In addition, a mixture of cleaning fluid and of propellant gas is expelled. Thus, by choosing the cleaning fluid and the shape of the diffuser in appropriate manner, it is possible to expel the cleaning fluid in foam form, and to improve the cleaning capacity. The feed head 3 can have a simple structure since it is not necessary to provide a pump or a valve for the cleaning fluid.

However, in a variant that is not shown, the cleaning apparatus may include a pump for cleaning fluid or may be connected to the water supply so that water can be used as the cleaning fluid.

Using cleaning apparatus as described above, it is possible to clean a gun in the following manner: the gun is positioned on the fluid-receiving member. The feed head 3 and thus the nozzle 5 are lowered into a coupling position in which they are coupled to the pain inlet of the gun. The aerosol receptacle is pressed until the inlet of the gun is filled. The gun is emptied by squeezing the trigger of the gun. The operations of pressing on the aerosol receptacle and of emptying the gun are reproduced as many times as is necessary. Said gun is dried by sending compressed air through the paint inlet of said gun. The head 3 and the associated nozzle 5 are raised again. The gun is extracted from the cleaning zone 22.

The invention claimed is:

1. A cleaning apparatus (1) for cleaning a spray gun (26) having at least one paint inlet (27) for fluid to be sprayed, and a fluid outlet (28), the fluid outlet (28) comprising at least one axial outlet (29) for the fluid to be sprayed and at least one radial pressurized gas outlet (30) for gas that adjusts a shape of a flow of the fluid being sprayed from the at least one axial outlet (29), said cleaning apparatus (1) comprising:

at least one support structure (2) that supports the spray gun (26) during a cleaning operation;

a fluid feed head (3) carried by said support structure (2), the fluid feed head (3) having i) at least one feed nozzle (5) delimiting a duct configured to be connected to the paint inlet (27) of the spray gun (26), and ii) at least two independent inlets (6, 7) for supplying fluid from the supply nozzle (5) into the paint inlet (27) of the spray gun (26), said at least two independent inlets (6, 7) including a first fluid inlet (6) with a first discharge (6A) into the duct of the feed nozzle (5) for feeding a first fluid to the feed nozzle (5), and a second fluid inlet (7) with a second discharge (7A) into the duct of the feed nozzle (5) for feeding a second fluid to the feed nozzle (5), the first discharge (6A) being separate and distinct from the second discharge (7A), the first inlet (6) configured to be connected to a cleaning fluid source, and the second inlet (7) configured to be connected to a compressed air source;

removal means (4) for removing, via the spray gun (26) during the cleaning operation, at least a fraction of the first and second fluids coming from the feed nozzle (5) of said fluid feed head (3); and a fluid collection means (16) connected to the removal means (4), the fluid collection means for collecting, from the fluid outlet (28) of the spray gun, a flow of sprayed fluid with the fraction of the first and second fluids during the cleaning operation, wherein the removal means (4) comprises at least one fluid-receiving member (14) comprised of i) an inlet configured to be connected to the fluid outlet (28) of the gun (26), ii) at least one receiving fluid-nozzle (15) with a) an inlet configured to be connected to the axial outlet (29) of the fluid outlet (28) of the spray gun (26) to thereby remove at least a part of the flow of sprayed fluid coming from the spray gun (26), and b) an outlet connected to an inlet of the fluid collection means (16) to thereby collect the part of the flow of sprayed fluid removed from the axial outlet (29) of the fluid outlet (28) of the spray gun (26), and iii) at least one gas discharge duct (17) with a) an inlet configured to be connected to the at least one radial pressurized gas outlet (30) of the spray gun (26), and b) an outlet that discharges, during the cleaning operation, into a gas removal zone to remove gases from the at least one radial pressurized gas outlet (30) of the spray gun into the gas removal zone, the gas removal zone being distinct from the fluid collection means (16) collecting the part of the flow of sprayed fluid removed from the axial outlet (29) of the fluid outlet (28) of the spray gun (26).

2. The cleaning apparatus (1) according to claim 1, wherein the feed nozzle (5) is coupled to the support structure (2) via at least one nozzle holder (8) that, in co-operation with the supply nozzle (5), forms the feed head (3), said nozzle holder (8) being in the shape of a tubular body extending along a vertical axis of the support structure, that is equipped, at its bottom end, with the feed nozzle (5) and with fluid feed inlets for feeding fluid to said nozzle, and that is open at its top end to form an opening through which there can be inserted a cleaning fluid source, such as an aerosol receptacle (24), into said nozzle holder (8), said aerosol receptacle (24) being suitable for being inserted via its diffuser (25), i.e. upside down, into the nozzle holder (8) until the diffuser (25) comes to be inserted at least partially into the cleaning fluid feed inlet (6) of the feed nozzle (5) that discharges into the duct of said feed nozzle 5).

3. The cleaning apparatus (1) according to claim 1, wherein said feed nozzle (5) is mounted to move relative to the support structure (2) towards or away from the removal means (4).

4. The cleaning apparatus (1) according to claim 1, wherein the feed nozzle (5) is mounted to move upwards and downwards between a high position remote from the removal means (4) and a low position close to said removal means (4), said low position being a position that is adjustable as a function of at least the dimensional characteristics of the spray gun to be cleaned.

5. The cleaning apparatus (1) according to claim 1, wherein each of the first and second discharges (6A, 7A) of the first and second fluid feed inlets (6, 7) of the feed nozzle (5) is an axial discharge of axis parallel to the longitudinal axis of the duct of the feed nozzle (5).

6. The cleaning apparatus (1) according to claim 1, wherein the feed nozzle (5) and said fluid-receiving member (14) are positioned relative to each other in a manner such as to be suitable for being connected at the same time respectively to said paint inlet (27) of the spray gun (26) and to the fluid outlet (28) of the spray gun.

7. The cleaning apparatus (1) according to claim 1, wherein the feed nozzle (5) and the fluid-receiving member (14) are mounted on the support structure (2) and define a cleaning volume which receives the fluid-receiving member (14) and into which the gun to be cleaned is suitable for being inserted, at least partially, said feed nozzle (5) having at least one position in which said feed nozzle is disposed at least partially inside said cleaning volume.

8. The cleaning apparatus (1) according to claim 1, wherein, said fluid-receiving member (14) has a ring (18) surrounding said fluid-receiving nozzle (15), the inlet of the at least one gas discharge duct (17) being provided between the ring (18) and the fluid-receiving nozzle (15).

9. The cleaning apparatus (1) according to claim 8, further comprising an annular sealing gasket (19) having a convex outside peripheral surface located inside said ring (18).

10. The cleaning apparatus (1) according to claim 9, wherein the annular sealing gasket (19), located inside the ring (18) is loaded by a spring and is urged back into a position in which the annular sealing gasket (19) bears against an inside peripheral circumferential shoulder of the ring (18).

11. The cleaning apparatus (1) according to claim 1, wherein the gas removal zone is formed by the ambient air surrounding said cleaning apparatus so that an end of the at least one gas discharge duct (17) discharges into the surrounding air.

12. The cleaning apparatus (1) according to claim 11, wherein, with the gas removal zone being formed by the ambient air surrounding the cleaning apparatus, the support structure (2), in a back zone, opposite from front opening, has at least one opening corresponding to the at least one gas discharge duct (17) discharging into the surrounding air.

13. The cleaning apparatus (1) according to claim 2, wherein said feed nozzle (5) is mounted to move relative to the support structure (2) towards or away from the removal means (4).

14. The cleaning apparatus (1) according to claim 6, wherein the feed nozzle (5) and the fluid-receiving member (14) are mounted on the support structure (2) and define a cleaning volume which receives the fluid-receiving member (14) and into which the gun to be cleaned is suitable for being inserted, at least partially, said feed nozzle (5) having at least one position in which said feed nozzle is disposed at least partially inside said cleaning volume.

15. The cleaning apparatus (1) according to claim 1, wherein said at least one fluid-receiving nozzle (15) of said fluid-receiving member (14) has a cylindrical-conical shape.

16. A combination of the cleaning apparatus (1) according to claim 1 and the spray gun (26).

* * * * *